US005847963A

United States Patent [19]

Gaiski

[11] Patent Number: 5,847,963

[45] Date of Patent: Dec. 8, 1998

[54] METHOD FOR MONITORING THE EFFECT OF ADJUSTMENTS OF PAINT APPLICATION EQUIPMENT

[76] Inventor: Stephen N. Gaiski, 595 Forest, Suite 1B, Plymouth, Mich. 48170

[21] Appl. No.: 545,549

[22] Filed: Oct. 19, 1995

[51] Int. Cl.[6] ..... B67D 5/30

[52] U.S. Cl. ..... 364/479.14; 364/479.1; 364/479.11; 364/479.13; 118/696; 118/712; 118/324; 118/314

[58] Field of Search ..... 364/479.1, 479.11, 364/479.13, 479.14, 509, 510, 468.01, 468.02, 468.18, 468.19, 468.2, 468.21, 474.34, 474.35, 550, 551.01, 564, 559; 118/712, 696, 324, 322, 314; 427/8, 9, 401, 402, 424, 345, 346; 901/43, 44; 239/69; 73/861.02

[56] References Cited

U.S. PATENT DOCUMENTS

| | | | |
|---|---|---|---|
| 4,992,952 | 2/1991 | Sosaki | 364/510 |
| 5,298,277 | 3/1994 | Hirose | 118/712 |
| 5,336,321 | 8/1994 | Sugata et al. | 901/43 |
| 5,531,833 | 7/1996 | Ogasawara et al. | 118/324 |

*Primary Examiner*—Emanuel Todd Voeltz
*Assistant Examiner*—Hal P. Wachsman
*Attorney, Agent, or Firm*—Charles W. Chandler

[57] ABSTRACT

A source reduction analysis software in a paint application system to minimize paint usage. The differences in paint volumes per paint applicators' settings are identified. These settings include trigger point count settings, and/or pushout count settings, and/or fluid pressure settings.

8 Claims, 11 Drawing Sheets

| PARAMETER | OLD VALUE | NEW VALUE | TIME | DATE |
|---|---|---|---|---|
| (STYLE: 2 COLOR: 8 BELL:31) | | | | |
| FLUID (PSI) ZONE #1 | 24 | 26 | 17:09:43 | 07-31-1995 |
| FLUID (PSI) ZONE #2 | 22 | 24 | 17:09:46 | 07-31-1995 |
| FLUID (PSI) ZONE #3 | 22 | 24 | 17:09:54 | 07-31-1995 |
| FLUID (PSI) ZONE #4 | 22 | 24 | 17:09:59 | 07-31-1995 |
| (STYLE: 1 COLOR: 8 BELL: 31) | | | | |
| FLUID (PSI) ZONE #1 | 24 | 26 | 17:11:21 | 07-31-1995 |
| FLUID (PSI) ZONE #2 | 19 | 21 | 17:11:28 | 07-31-1995 |
| FLUID (PSI) ZONE #3 | 19 | 21 | 17:11:32 | 07-31-1995 |
| FLUID (PSI) ZONE #4 | 24 | 26 | 17:11:41 | 07-31-1995 |
| SHAPING AIR (PSI) ZONE #14 | 0 | 30 | 17:13:31 | 07-31-1995 |
| SHAPING AIR (PSI) ZONE #14 | 30 | 0 | 17:13:37 | 07-31-1995 |

| PARAMETER | OLD VALUE | NEW VALUE | TIME | DATE |
|---|---|---|---|---|
| (STYLE: 3 COLOR: 8 RECIP: 51 | | | | |
| PUSHOUT POSITION | 5 | 15 | 17:17:18 | 07-31-1995 |
| (STYLE: 2 COLOR: 8 RECIP: 52 | | | | |
| STROKE ON CONV COUNT #1 (ROOF | 58 | 40 | 17:29:28 | 07-31-1995 |
| (STYLE: 3 COLOR: 8 RECIP: 52 | | | | |
| STROKE ON CONV COUNT #1 (ROOF | 58 | 40 | 17:29:40 | 07-31-1995 |
| (STYLE: 3 COLOR: 8 RECIP: 52 | | | | |
| STROKE ON CONV COUNT #1 (ROOF | 58 | 40 | 17:20:50 | 07-31-1995 |
| (STYLE: 3 COLOR: 11 RECIP: 52 | | | | |
| FLUID (PSI) ZONE #2 RECIPS | 30 | 20 | 17:50:59 | 07-31-1995 |
| FLUID (PSI) ZONE #3 RECIPS | 25 | 20 | 17:51:04 | 07-31-1995 |
| (STYLE: 2 COLOR: 11 RECIP: 52 | | | | |
| FLUID (PSI) ZONE #2 RECIPS | 30 | 20 | 17:51:13 | 07-31-1995 |

FIG. 6a

| PARAMETER | OLD VALUE | NEW VALUE | TIME | DATE |
|---|---|---|---|---|
| (STYLE: 1 COLOR: 1 BELL: 22) | | | | |
| FLUID (PSI) ZONE #1 | 20 | 60 | 15:19:37 | 07-31-1995 |
| FLUID (PSI) ZONE #1 | 60 | 35 | 15:20:12 | 07-31-1995 |
| (STYLE: 1 COLOR: 1 BELL: 12) | | | | |
| FLUID (PSI) ZONE #1 | 20 | 35 | 15:20:27 | 07-31-1995 |
| (STYLE: 2 COLOR: 9 BELL: 12) | | | | |
| FLUID (PSI) ZONE #2 | 75 | 80 | 15:21:35 | 07-31-1995 |
| (STYLE: 3 COLOR: 9 BELL: 12) | | | | |
| FLUID (PSI) ZONE #2 | 75 | 80 | 15:21:46 | 07-31-1995 |
| (STYLE: 3 COLOR: 9 BELL: 22) | | | | |
| FLUID (PSI) ZONE #2 | 78 | 80 | 15:22:06 | 07-31-1995 |
| (STYLE: 2 COLOR: 9 BELL: 22) | | | | |
| FLUID (PSI) ZONE #2 | 78 | 80 | 15:22:14 | 07-31-1995 |
| (STYLE: 2 COLOR: 9 BELL: 13) | | | | |
| FLUID (PSI) ZONE #2 | 45 | 50 | 15:23:07 | 07-31-1995 |
| FLUID (PSI) ZONE #2 | 50 | 55 | 15:23:39 | 07-31-1995 |
| FLUID (PSI) ZONE #3 | 45 | 50 | 15:23:52 | 07-31-1995 |
| (STYLE: 2 COLOR: 8 BELL: 31) | | | | |
| FLUID (PSI) ZONE #2 | 19 | 22 | 15:24:32 | 07-31-1995 |
| FLUID (PSI) ZONE #3 | 19 | 22 | 15:24:34 | 07-31-1995 |
| FLUID (PSI) ZONE #4 | 22 | 22 | 15:24:36 | 07-31-1995 |
| (STYLE: 3 COLOR: 8 BELL: 31) | | | | |
| FLUID (PSI) ZONE #2 | 19 | 22 | 15:24:54 | 07-31-1995 |
| FLUID (PSI) ZONE #3 | 17 | 22 | 15:24:57 | 07-31-1995 |
| (STYLE: 3 COLOR: 9 BELL: 32) | | | | |
| FLUID (PSI) ZONE #2 | 11 | 15 | 15:25:22 | 07-31-1995 |
| FLUID (PSI) ZONE #3 | 16 | 15 | 15:25:25 | 07-31-1995 |
| (STYLE: 2 COLOR: 8 BELL: 32) | | | | |
| FLUID (PSI) ZONE #3 | 16 | 81 | 15:25:44 | 07-31-1995 |
| FLUID (PSI) ZONE #2 | 11 | 15 | 15:25:48 | 07-31-1995 |
| (STYLE: 2 COLOR: 9 BELL: 34) | | | | |
| FLUID (PSI) ZONE #2 | 13 | 15 | 15:26:09 | 07-31-1995 |
| FLUID (PSI) ZONE #3 | 13 | 15 | 15:26:11 | 07-31-1995 |
| (STYLE: 3 COLOR: 8 BELL: 34) | | | | |
| FLUID (PSI) ZONE #2 | 15 | 18 | 15:26:30 | 07-31-1995 |
| FLUID (PSI) ZONE #3 | 15 | 18 | 15:26:32 | 07-31-1995 |
| FLUID (PSI) ZONE #4 | 15 | 18 | 15:26:34 | 07-31-1995 |
| (STYLE: 2 COLOR: 5 BELL: 34) | | | | |
| FLUID (PSI) ZONE #2 | 15 | 12 | 15:26:54 | 07-31-1995 |
| FLUID (PSI) ZONE #3 | 15 | 18 | 15:25:55 | 07-31-1995 |

FIG. 6b

CONVERSION TABLE: FLUID PRESSURE SETTINGS (PSI) TO APPLICATIONS FLOW RATES (CC/MIN)

| PSI | 1.2 | 2.2 | 1.3 | 3.1 | 3.2 | 3.4 | 5.1 | 5.2 |
|---|---|---|---|---|---|---|---|---|
| 10 | 15.00 | -10.00 | -7.50 | 5.00 | 2.50 | 10.00 | 38.33 | 16.67 |
| 15 | 37.50 | 9.00 | 14.50 | 24.50 | 19.50 | 28.50 | 63.33 | 35.67 |
| 20 | 60.00 | 28.00 | 36.50 | 44.00 | 36.50 | 47.00 | 88.33 | 58.67 |
| 25 | 82.50 | 47.00 | 58.50 | 63.50 | 53.50 | 65.50 | 113.33 | 76.67 |
| 30 | 105.00 | 66.00 | 80.50 | 83.00 | 70.50 | 84.00 | 138.33 | 98.67 |
| 35 | 127.50 | 85.00 | 102.50 | 102.50 | 87.50 | 102.50 | 163.33 | 118.67 |
| 40 | 150.00 | 104.00 | 124.50 | 122.00 | 104.50 | 121.00 | 188.33 | 136.67 |
| 45 | 172.50 | 123.00 | 146.50 | 141.50 | 121.50 | 139.50 | 213.33 | 156.67 |
| 50 | 195.00 | 142.00 | 168.50 | 161.00 | 138.50 | 158.00 | 238.33 | 176.67 |
| 55 | 217.50 | 161.00 | 190.50 | 180.50 | 155.50 | 176.50 | 263.33 | 196.67 |
| 60 | 240.00 | 180.00 | 212.50 | 200.00 | 172.50 | 195.00 | 288.33 | 316.67 |
| 65 | 262.50 | 199.00 | 234.50 | 219.50 | 189.50 | 213.50 | 313.33 | 236.67 |
| 70 | 285.00 | 218.00 | 256.50 | 239.00 | 206.50 | 232.00 | 338.33 | 256.67 |
| 75 | 307.50 | 237.00 | 278.50 | 258.50 | 223.50 | 250.50 | 363.33 | 276.67 |
| 80 | 330.00 | 256.00 | 300.00 | 278.00 | 240.50 | 269.00 | 388.33 | 296.67 |

FIG. 7

FLOW ZONE CONVERSION TABLE: NUMBER OF COUNTS PER FLOW ZONE

| ZONE #1 | ZONE #2 | ZONE #3 | ZONE #4 |
|---|---|---|---|
| 0 COUNTS | 85 COUNTS | 72 COUNTS | 37 COUNTS |

FIG. 8

CONVERSION TABLE: PAINT COLOR VOLUME PERCENTAGES OF EACH COLOR SPRAYED

| COLOR | PERCENT VOLUME OF TOTAL PAINT SPRAYED |
|---|---|
| ONE | 14.11% |
| TWO | 7.06% |
| THREE | 5.88% |
| FOUR | 10.59% |
| FIVE | 9.41% |
| SIX | 11.77% |
| SEVEN | 2.94% |
| EIGHT | 11.77% |
| NINE | 7.06% |
| TEN | 2.94% |
| ELEVEN | 16.47% |

FIG. 9

METHOD FOR MONITORING THE EFFECT OF ADJUSTMENTS OF PAINT APPLICATION EQUIPMENT

FIELD OF THE INVENTION

This invention relates to a system for minimizing paint usage by computer-operated paint application equipment by analyzing the paint consumption at one or more applicators. The system uses software that integrates source reduction analysis for each applicator.

BACKGROUND OF THE INVENTION

Manufacturers of painted products, such as automotive bodies, commonly assess paint used by several paint booths at the end of each production month. Paint suppliers may also provide this data to the manufacturer at the end of each day, week or month.

Paint per unit trends are calculated and reported on a daily, weekly or monthly time frame. These trends are based on the total number of items produced, and paint usage reported from inventory levels of all paint booths rather than the application equipment of individual booths.

The application equipment typically comprises numerous applicators that must be adjusted on an individual basis, see FIG. 1. The applicator equipment manufacturer usually recommends trigger point count settings, see FIG. 2, and pushout count settings to minimize paint usage for all paint application equipment.

Trigger point count settings determine the on/off position for each applicator as a workpiece is conveyed horizontally past an applicator location. Pushout count settings determine the paint expelled from each applicator's paint supply line at the end of the painting cycle. However, since spray booth dynamics affect paint quality, trigger point count settings and pushout point count settings are changed during the working shift by the operator based on the current spray booth's operating conditions. For example, a change may be made because the paint thickness is not satisfactory at specific areas of the vehicle body. The trigger points may be adjusted or the paint pressure changed.

Each workpiece moves past each paint applicator at a line speed that is converted to counts. A count is a linear measurement, such as inches, and refers to the inches of conveyor that passes the applicator location, measured from the location of the conveyor at the beginning of the paint cycle.

The applicator equipment manufacturer also recommends flow zones for applicators in which fluid air pressure and shaping air pressure settings are determined. These zones are based on the individual paint applicator and its conveyor count. They are established independent of the trigger point settings. Flow zones allow for accurate control of paint thickness on all areas of the painted surface. These zones also determine the flow rate of the paint that is being sprayed. Unfortunately, spray booth dynamics affect fluid air pressure which results in different application rates.

Paint manufacturers supply either daily, weekly or monthly paint usages. On a periodic basis, with each product change, or at the manufacturer's suggestion, trigger point count settings, pushout count settings and flow rates are reviewed. However, daily reviews are not conducted which ascertain paint used by each applicator even though operator changes vary the individual applicator paint consumption based on the current spray booth dynamics.

Automotive manufacturers use software that records on a daily basis all operator changes, and the time of such changes for each paint applicator. The software does not analyze the net result of the operator changes in terms of paint usage for each applicator.

Consequently, all the previous attempts at source reduction analysis of paint applicator equipment suffer from a number of disadvantages:

(a) The impact on paint consumption of individual applicators' trigger point count changes are not assessed on a daily basis. This results in substantial paint wastage and excessive costs.

(b) Operator changes of individual applicators' fluid pressures, which determine paint application rates, are not assessed on a daily basis in terms of paint usage. This results in substantial paint wastage and excessive costs.

(c) The applicator equipment manufacturer's recommendations for specific applicator's pushout count settings are nullified by actual spray booth conditions. This results in excessive paint being flushed out of the paint line rather than being pushed out of the paint line onto the workpiece.

(d) The applicator equipment manufacturer's recommendations for specific applicator's pushout count settings and fluid pressures are affected by the densities of the different types of paint used. Pushout count settings are adversely affected since this results in excess paint being flushed out of the paint line rather than being pushed out of the paint line onto the workpiece. Excessive fluid pressures result in excess paint being applied to the workpiece.

(e) Periodic assessments of applicators allow for excessive paint wastes. Daily paint wastes, and costs per applicator are not identified.

(f) Presently used software records only changes made to each applicator settings in terms of trigger points count settings, pushout count settings, and fluid pressures. Paint usages, and costs are not calculated per applicator to make timely corrections to the applicator to reduce paint consumption.

(g) Paint exiting an applicator that misses the workpiece results in a condition known as overspray. Paint overspray requires treatment to render it non-tacky. Manufacturer's costs are increased by obtaining additional products to detackify excessive overspray that is a result of a new applicator setting.

(h) Excessive paint overspray per applicator also results in the costs of excessive booth maintenance chemicals used for the cleaning and maintenance of the spray booth. The manufacturer must pay for additional booth maintenance cleaning costs and chemicals.

(i) Paint wastage per applicator produces additional paint sludge. Sludge disposal and transportation costs are incurred by the manufacturer.

(j) Paint wastage per applicator results in more paint reducing solvent being consumed. The manufacturer must pay for additional solvent costs.

(k) Paint supply lines per applicator are frequently changed with different length hoses. Pushout count settings per applicator are adjusted to compensate for the additional paint that must be expelled from paint supply hoses that are longer in length. Paint is wasted, and additional costs are incurred.

(l) The operator changes per applicator made on a daily basis on trigger points' count settings, pushout count settings, and flow rates are numerous. The current industry perception is this data cannot be analyzed on a daily basis to determine the changes in paint usage per day per applicator. A system does not exist that analyzes this data per applicator for differences in paint usage. Paint is wasted per applicator on a daily basis due to spray booth conditions that can be corrected if the proper data were available to justify the costs of correction.

SUMMARY OF THE INVENTION

The preferred embodiment of the invention uses software in a computer that downloads the daily records of the operator changes to the individual applicators in a multiple applicator system. The operator makes these changes to the paint equipment using the same computer that records the changes. The records are analyzed to determine the cumulative effect of the changes to paint consumption traced to all changes to the trigger point settings, the pushout settings and the paint pressures for each body style. These cumulative changes are based on the change to the counts of the trigger points, the pushout count settings using a conversion table, and changes in the fluid pressure using two conversion tables to account for the densities of different paints and the percent of each paint color sprayed in comparison to the total volume of all colors painted. The change in counts is then converted to changes in paint consumption. The comparisons are then used to determine appropriate equipment adjustments to retain proper paint thickness, but minimizing paint consumption.

Accordingly, several objects and advantages of the present invention are:

(a) to incorporate into the painting system software that identifies changes in paint usages, due to operator changes in the trigger point count settings per applicator that can be revealed if the difference in paint usage were known;

(b) to incorporate into the painting system software that identifies changes in paint usages, due to operator changes to fluid pressure per applicator that can be revealed if the difference in paint usage were known;

(c) to incorporate into the painting system software that identifies changes in paint usages, due to operator changes to the pushout count settings per applicator that can be revealed if the difference in paint usage were known.

(d) to incorporate into the painting system software that identifies changes in paint usages, due to operator changes to the fluid pressures per applicator that depend upon the paint color or paint density;

(e) to incorporate into the painting system software that enables the user to make daily assessments per applicator of the differences obtained in paint usage due to operator changes of the paint applicator;

(f) to incorporate into the painting system software that compiles the difference in paint usages in terms of trigger point count settings per applicator, pushout count settings per applicator, and fluid pressure settings per applicator;

(g) to incorporate into the painting system software that identifies the changes in paint usage per applicator to avoid excessive detackification products and costs;

(h) to incorporate into the painting system software that identifies the changes in paint usage per applicator to avoid excessive paint spray booth maintenance, and cleaning costs;

(i) to incorporate into the painting system software that identifies the changes in paint usage per applicator to avoid excess paint sludge generation, excessive paint sludge disposal costs, and excess paint sludge transportation costs;

(j) to incorporate into the painting system software that identifies the changes in paint usage per applicator to avoid excessive solvent costs and usage for the purpose of reducing the excessive paint;

(k) to incorporate into the painting system software that identifies the changes in paint usage per applicator by pushout count settings that are changed due to paint supply lines that are different in length; and (l) to incorporate into the painting system software that identifies the changes in paint usage per applicator on a daily basis to analyze the data from operator changes made per applicator in regards to trigger point count settings, pushout count settings and fluid pressures.

(m) to convert paint consumption from trigger point count settings, pushout count settings and paint pressure to a common denominator, i.e. counts, so that realistic comparisons can be made for determining corrections to the paint equipment.

Still further objects and advantages will become apparent from a consideration of the ensuing description and drawings.

BRIEF DESCRIPTION OF THE DRAWINGS

FIGS. 6*a* and 6*b* respectively are printouts of typical current plant data of changes to compilation paint applicator equipment. (Bell and/or Recip identifies applicator nozzle).

FIG. 7 provides a conversion table of fluid pressures to paint applicators' flow rates.

FIG. 8 provides a conversion table of count settings per flow zone for flow rate calculations.

FIG. 9 provides a conversion table for pushout count settings to account for the percent of each paint color sprayed in comparison to the total volume of all colors painted.

A value of 0.037 gallons per applicator is significant, since a typical assembly plant possesses ten to seventy plus individual paint applicators within the spray booths.

Paint costs range from $25.00/gallon to greater than $100.00 per gallon.

Production days for a typical facility are at 276 days. One production month equates to 23 calendar days. Consequently, if ten individual applicators were adjusted by 0.037 gallons per day, this would represent an annual cost increase of either $2,553.00 ($25.00/gallon paint price) or $10,212.00 ($100.00/gallon paint price) for the manufacturing facility. A facility with 70 applicators would experience an annual cost increase of $17,871.00 ($25 per gallon price) or $71,484.00 ($100 per gallon price).

At the end of the specification is the Visual Basic Application Add-In Feature "PAI-APP.XLA" works with Workbook "PAI-DAT.XLS" for Paint Applications: Source Reduction Analysis September 1995 which is a copy of the printed source code of the Excel Add-In application PAI-APP.XLA.

At the end of the specification is the PAINT APPLICATIONS: Source Reduction Analysis Software Demonstration Instructions which is a copy of detailed instructions for conducting a source reduction analysis software demonstration with paint applicator's data.

At the end of the specification are the Style 2 and Style 3 tables which show paint usage data compilation for two style vehicles resulting from using the invention.

DESCRIPTION OF THE PREFERRED EMBODIMENT

Figure 1:
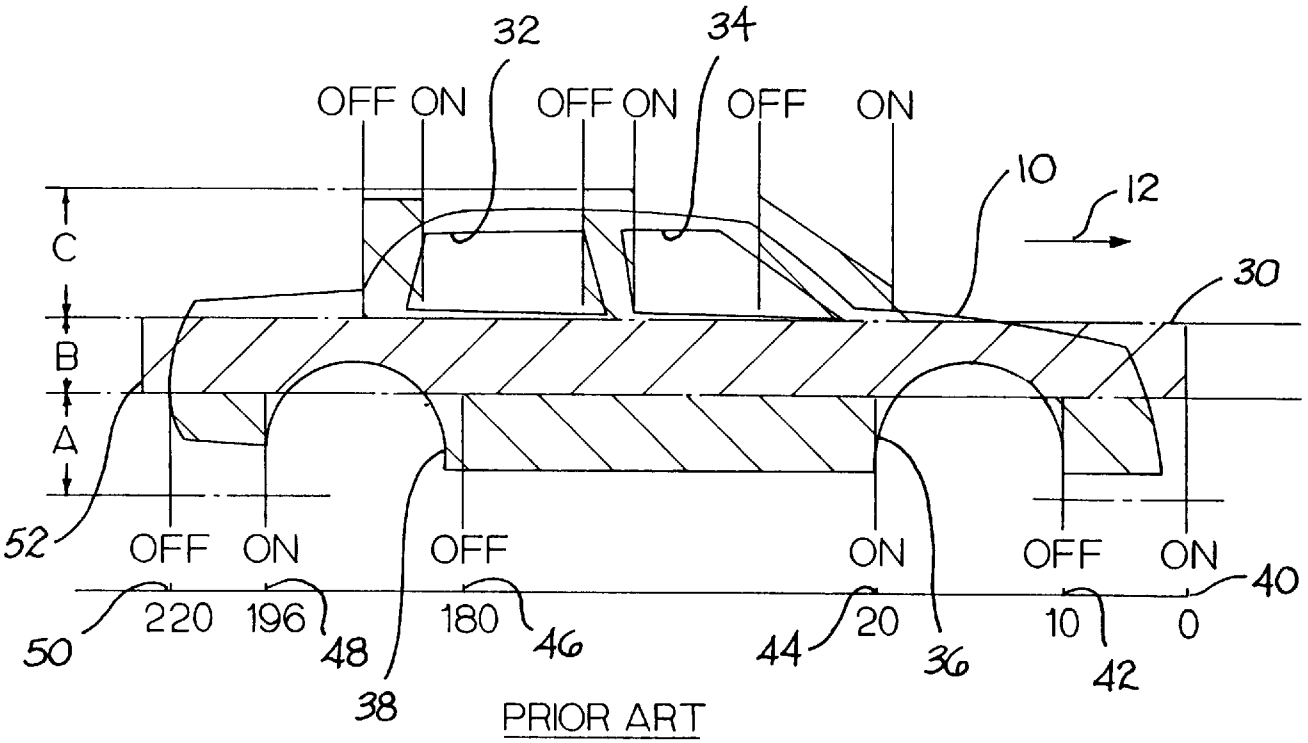
PRIOR ART FIG. 1
FIG. 1 is a view of a automotive vehicle overlaid with patterns illustrating the trigger points of three typical paint applicators.
Figure 2:
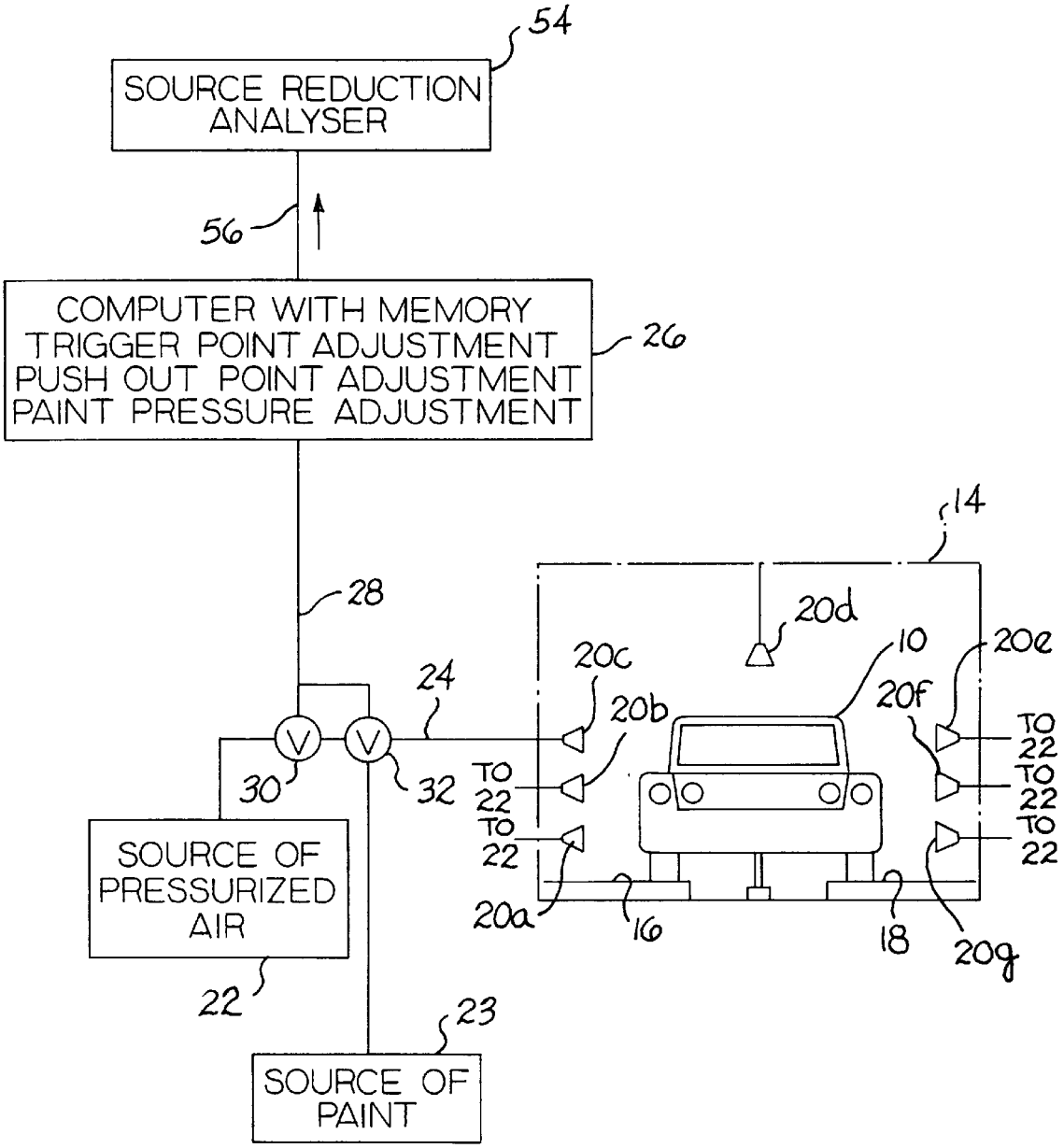
PRIOR ART FIG. 2
FIG. 2 is a view showing the location of the paint applicator arrangement in a typical painting booth.

Referring to the drawings, FIGS. 1 and 2 illustrate a vehicle sheet metal body 10, moving in the direction of arrow 12 through a paint booth 14. Sheet metal body 10 is horizontally advanced on conveyor means 16 and 18 through the booth. A plurality of conventional paint applicator nozzles 20*a*, 20*b*, 20*c*, 20*d*, 20*e*, 20*f*, and 20*g* are mounted in the spray booth and each is connected to a source of pressurized air 22 and a source of paint 23 through conduit means 24. The paint and the pressurized air are delivered from separate sources in the manner well known to those skilled in the art. The individual nozzle operation is controlled from a mainframe computer 26 which delivers appropriate signals through connections 28 to valves 30 and 32 for controlling the time and duration of the paint and air delivered from their respective sources.

Many environmental factors influence the quality of the coating of paint applied to the vehicle. Further, successive vehicles in a paint line frequently have a different body style and use a different color paint. For illustrative purposes, paint booths may accommodate up to 24 different colors and three different body styles. To accommodate these many factors, computer 26 is programmed to turn the individual nozzles on and off depending upon line speed, the particular profile of the vehicle body, the location of the window openings and so forth.

A count is a linear measurement of the conveyor length that passes a particular point such as a paint nozzle location.

The computer turns the nozzles on or off depending upon count settings measured from the location of the conveyor at the beginning of the paint cycle for each vehicle body.

Three primary factors which can be changed by the operator controlling the computer substantially influence the quantity and quality of the paint coating applied to the vehicle. These are respectively the trigger point settings, the pushout point settings, and the paint pressure. Each can be adjusted from computer 26. Of these adjustable factors, two are commonly measured in terms of "counts".

Referring to FIG. 2, assuming nozzles 20*a*, 20*b*, and 20*c* are spraying the right side of the vehicle body, each nozzle sprays a horizontal pattern having vertical widths, generally illustrated at A, B, and C, respectively in FIG. 1. Since a substantially continuous sheet metal surface passes nozzle 20*b*, the spray pattern 30 of this nozzle is substantially continuous from the front of the vehicle to the rear of the vehicle. However, note that the spray pattern of nozzle 20C includes window openings 32 any 34. Since it is not economical to spray on space void, the computer is programmed to turn nozzle 20C on and off as the vehicle passes the on/off locations designated in FIG. 1. Similarly, lower nozzle 20A sprays a discontinuous path interrupted by the openings formed by wheel wells 36 and 38.

For example, a nozzle may be turned on at a trigger point setting at location 40 in advance of the vehicle body and then turned off at a trigger point setting at location 42 which may be ten inches (10 counts) rearwardly of location 40 and also rearward of the front of the vehicle. One count typically equals one inch. The computer is then programmed to turn the nozzle on again at a trigger point setting location 44, 20" from location 40. The nozzle remains on until location 46, 160" rearward of location 44. The nozzle is turned off so as not to spray through the wheel well opening and then is turned on again at location 48 and turned off again at location 50.

The spray pattern extends beyond location 20 to location 52 because air is delivered to the delivery conduit 24 to empty the remaining paint in the hose at the end of the paint cycle. The pushout on/off points extend from location 50 to location 52 and is also measured in counts.

Each nozzle is controlled from the computer which is activated as a trigger point setting approaches the nozzle. The pushout air pushes the paint in the hose system out on the final inches of the vehicle body to both minimize wasted paint and to help to clear the system of paint before the cleaning cycle takes place.

During the course of a production day, each of the pushout point settings and trigger point settings may be adjusted by the operator for a variety of reasons but usually in order to ensure a complete and uniform thickness of paint on the body. For example if the paint appears to be somewhat thin adjacent the rear wheel well, he may increase the pressure, or relocate the trigger off point setting from location 42 to a location at couple of inches rearwardly. This helps to improve the coating but also consumes more paint. Other adjustments may be made for this or a variety of other reasons, such as the humidity and so forth. Computer 26 records each of these adjustments as well as the time of the adjustments. However, sometimes a condition which required an adjustment, ceases to exist, but the nozzle is not readjusted. Accordingly, considerable wastage can occur from these adjustments.

In order to define wastage, paint consumption is measured in terms of the counts computed for each nozzle. The trigger point count changes is a direct measurement of the change in trigger point settings. The change in pushout point settings is also a direct measurement of the change in settings. Changes in flow rate are calculated as a function of the change in pressure, the characteristics of the particular valve (FIG. 7) where the valves are identified as 1.2, 2.2, 1.3, etc., and the flow zone of the nozzle (FIG. 8), and a function of the paint characteristics, such as from a previous days count for the comparable adjustment and the percent of each paint color sprayed in comparison to the total volume of all colors painted. The operator can then determine a significant increase or reduction by using software installed in a second computer or source reduction analyzer 54, by downloading the data or log for the current days production and changes through an electronic connection 56 from computer 26.

Figure 3:
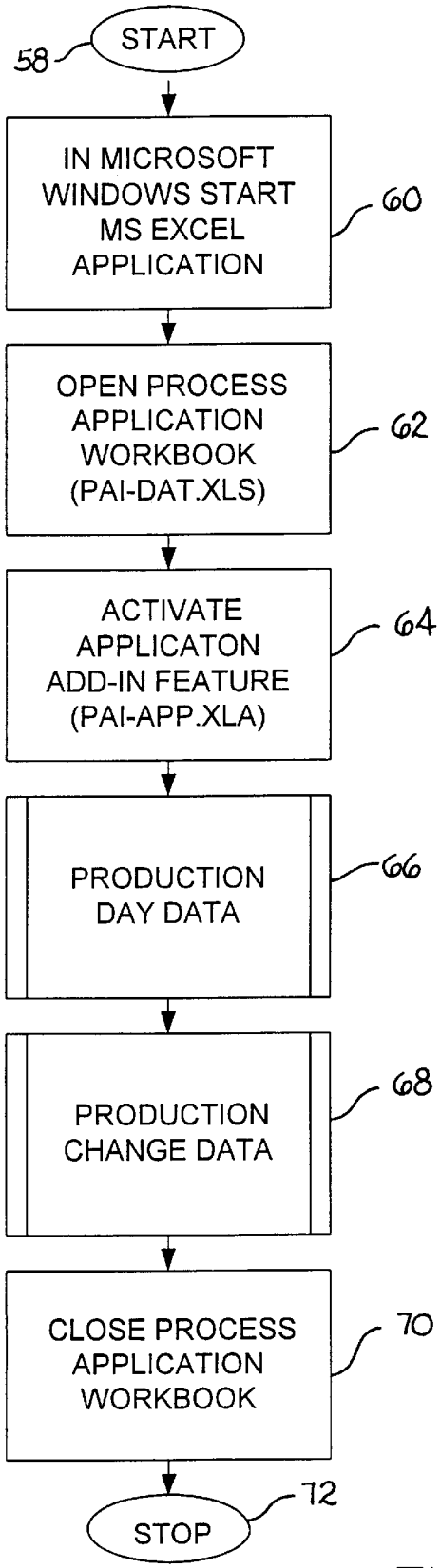
FIG. 3 is an overall flow chart of the computer software incorporated in the present invention.

The flow chart software integration of source reduction analysis to paint applications is illustrated in FIG. 3. The integration compiles the data in regards to the changes that occurred in paint usage per applicator due to differences in trigger point count settings, pushout count settings, and fluid pressures.

The computer software, used to analyze the daily production and change data is in Microsoft Windows 3.1, utilizing the Excel software application. These software programs are available from Microsoft Corporation of U.S.A. However, any suitable software program may be used.

Upon the commencement of this software data assessment, the computer is first started at the completion of the production day, as illustrated in FIG. 3. The next step is to access the Windows 3.1 software program as illustrated in box 60. Once in the Windows program, the Excel application is chosen. At the end of the specification is the PAINT APPLICATIONS: Source Reduction Analysis Software Demonstration Instructions which provides the specific steps, monitor displays, and the Excel application used to present plant data with the integration of the source reduction analysis.

Referring to FIG. 3, circle 58 is the standard identification that is used to begin a flow chart.

Box 60 indicates the starting of the Microsoft Excel application within the Microsoft Windows 3.1 software.

Box 62 indicates a step within the Excel application that allows the opening of the workbook on the sample file PAI-DAT.XLS. (The PAINT APPLICATIONS: Source Reduction Analysis Software Demonstration Instructions, at the end of the specification);

Box 64 indicates an option within Excel to activate an Add-In Feature (the sample is PAI-APP.XLA). This is an additional function which is not normally provided by Excel.

Figure 4:
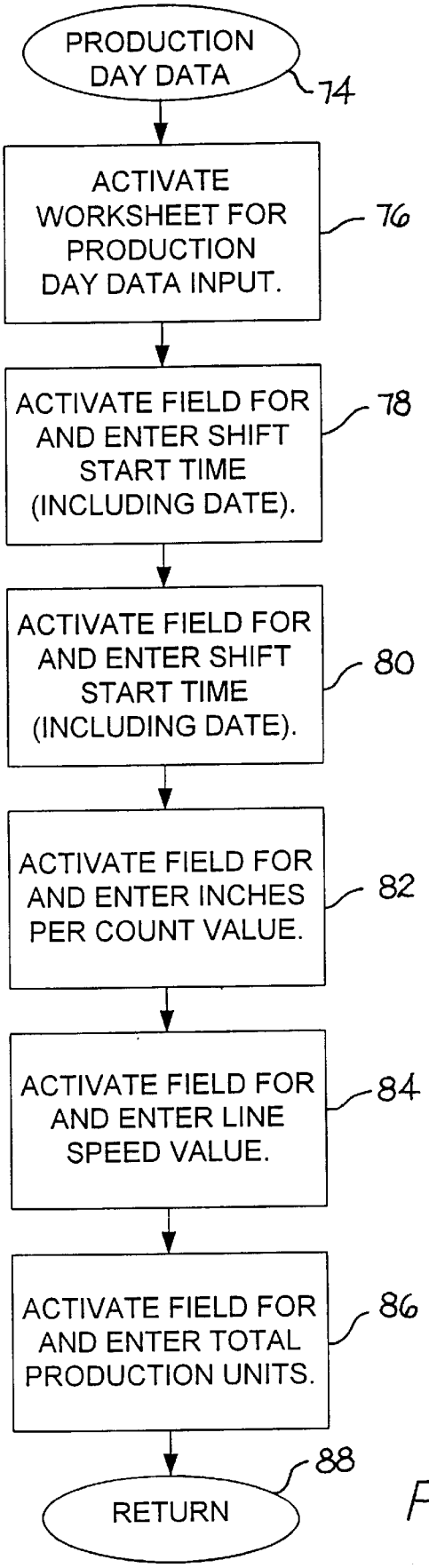
FIG. 4 is a flow chart of the part of the software for entering the daily production data into the software.

Box 66 indicates a step to reference a subroutine named Production Day Data, which is expounded on in FIG. 4.

Figure 5:
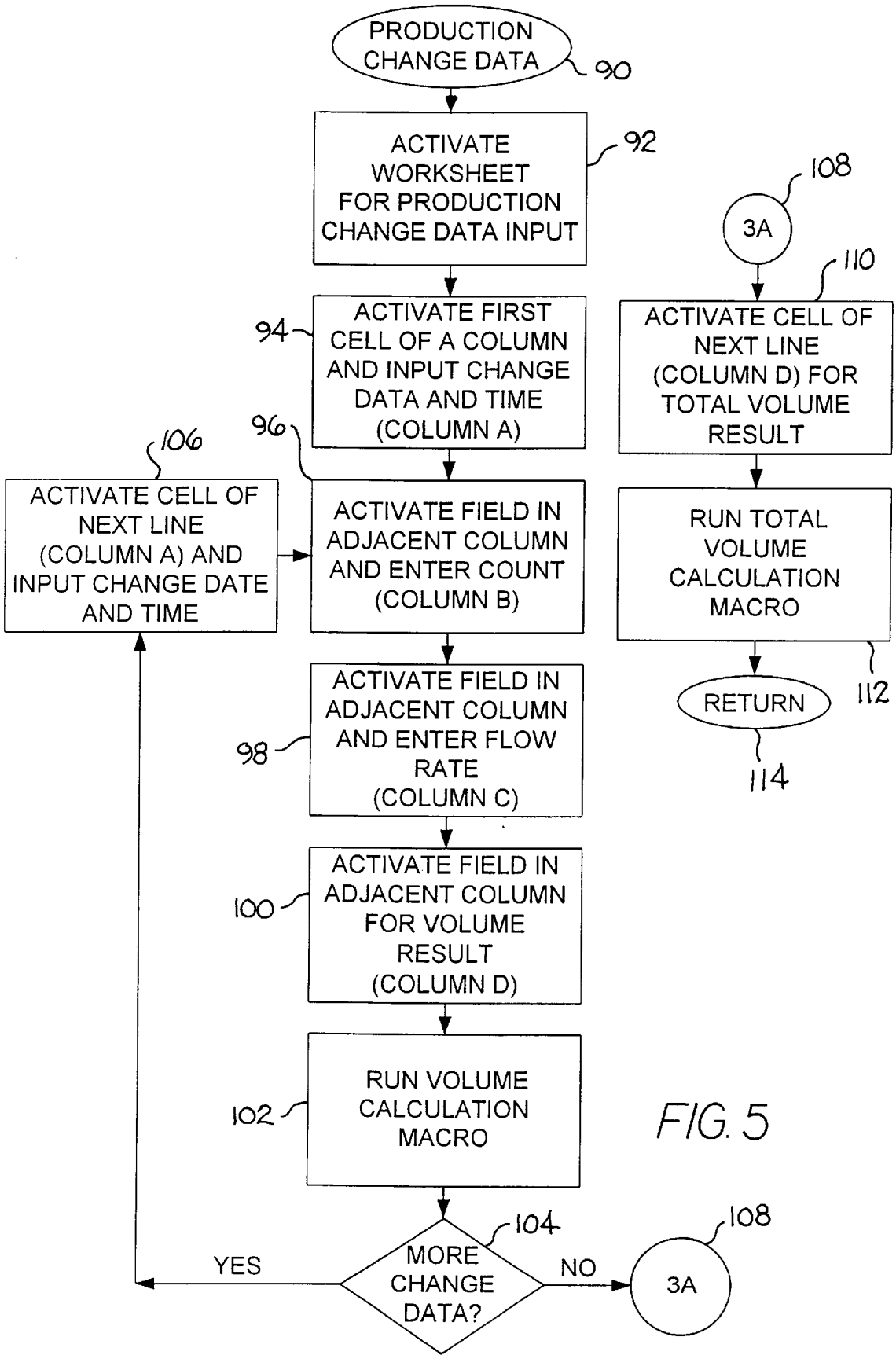
FIG. 5 is a flow chart of the part of the software for entering the production change data.

Box 68 indicates a step to reference a subroutine named Production Change Data which is expounded on in FIG. 5.

Box 70 indicates a step within the Excel application that allows us to close the workbook on the sample file PAI-DAT.XLS.

Circle 72 is the standard identification used to end a flowchart.

The source reduction analysis software utilizes constants from each production day that are entered for the user's facility data to the source reduction analysis software program. This information is compiled into the production day data subset as illustrated in box 66. The flowchart of the subset is illustrated in FIG. 4. The constants obtained from each production day includes the shift start time, shift calendar date, the linear measurement counts, expressed in inches, the line speed expressed in feet per minute, and the total production units manufactured during the selected production day.

The analysis of a typical production day data is illustrated in FIG. 4.

Circle 74 indicates the start of the subroutine named Production Day Data.

Box 76 indicates the selection of the worksheet, Production Day Data in the Excel application which makes it active.

Box 78 indicates a field for the identification of data that pertains to shift/start time, and calendar date.

Box 80 indicates a field for the identification of data that pertains to shift/stop time, and calendar date.

Box 82 indicates a field for the identification of data that pertains to values of inches per count.

Box 84 indicates a field for the identification of data that pertains to values of line speed.

Box 86 indicates a field for the identification of data that pertains to total production units/style.

Circle 88 indicates the end of the subroutine and the process returns to the point from where the subroutine was referred to, in this case FIG. 3, and the process continues with the next step.

The next step in the process analyzes the downloaded data from the manufacturers' computer 26. Variables are imputed that affect paint usage during the production day. These variables include the difference in trigger point count settings, the difference in pushout count settings, and the difference in applicator flow rates which is obtained from the difference in fluid pressures.

The analyses of the operator changes per applicator for the production day and the calculation of past usage is indicated in FIG. 5.

Circle 90 indicates the start of the subroutine named Production Change Data.

Box 92 indicates the selection of the worksheet, Production Change Data in the Excel application which makes it active.

Box 94 indicates the selection of the upper left cell of the worksheet that is in the Excel application for Production Change Data that is identified as column A1.

Box 96 indicates the selection of a cell to the immediate right of the previous step for the purpose of entering the count data.

Box 98 indicates the selection of a cell to the immediate right of the previous step for the purpose of entering the flow rate data.

Box 100 indicates the selection of a cell to the immediate right of the previous step in preparation for running a volume calculation macro.

Box 102 indicates the execution of a calculation macro contained within the Add In Feature of the Excel application which refers back to box 64.

Diagram 104 indicates a decision process based on the given question, is there more change data to enter or process?

Box 106 indicates the activation of a cell that is one below the cell that was referenced in box 94. Each successive entry will select a cell that was referred to in 106.

Box 108 indicates a continuation of the flow chart on another part of the same page.

Box 110 indicates the activation of a cell that is immediately below the current position that was identified in box 100.

Box 112 indicates the execution of a calculation macro contained within the Add In Feature of the Excel application which refers back to box 64.

Circle 114 indicates the end of the subroutine and the process returns to the point from where the subroutine was referred to, in this case FIG. 3, and the process continues with the next step.

Sample data and calculation of volume of paint resulting from changes are shown in the Style 2 and Style 3 table, at the end of the specification.

Two variables, pushout count settings, and fluid pressures require conversion tables. These conversion tables are illustrated in FIGS. 7 to 9. Pushout count settings conversion table account for the percent of each paint color sprayed in comparison to the total volume of all colors painted. The flow rates are derived from a fluid pressure conversion table per color to application rates, and a flow zones conversion table per applicator that identifies the number of counts per flow zone area and the comparison table that account for the percent of each paint color sprayed in comparison to the total volume of all colors painted. The time of each change is specified to compensate for the amounts of units that were manufactured, and that will be manufactured after each change. Changes in paint volumes per applicator is calculated from these variables. This information is compiled into the production change data subset as illustrated in box 68. The flowchart of the subset is illustrated in FIG. 5.

Changes in paint volumes per applicator (abbreviated as CVolume) are calculated using the data and formula illustrated in the Visual Basic Application Add-In Feature "PAI-APP.XLA" works with Workbook "PAI-DAT.XLS" for Paint Applications: Source Reduction Analysis September 1995, at the end of the specification. The formula requires the following input variables: count change (abbreviated as Cnt), inches per count (abbreviated as Ipc), line speed with units expressed in minutes per foot (abbreviated as Lsp), production startdate/time (abbreviated as Dt1), change date/time (abbreviated as Dt2), production end date/time (abbreviated as Dt3), total production/style day units (abbreviated as Tt1), application rate in cubic centimeters or milliliters per minute (abbreviated as Apr), and previous application rate (abbreviated as Apc).

The formula calculates the paint volume difference per each paint applicator change that involves a difference in trigger point count settings, a difference in push-out count settings, and a difference in fluid pressures which are converted to flow rates. Summation of the individual paint volume differences per applicator are included with the software program as illustrated in the PAINT APPLICATIONS: Source Reduction Aanlysis Software Demonstration Instruction, at the end of the specification.

The actual formula is illustrated in the Visual Basic Application Add-In Feature "PAI-APP.XLA" works with Workbook "PAI-DAT.XLS" for Paint Applications: Source Reduction Analysis September 1995, at the end of the specification, and comprises the following equation using the aforementioned abbreviations:

CVolume=(Cnt*Ipc*(Lsp*5.0)*(((Dt3−Dt2)/(Dt3−Dt1))*TtL)*(Apr/60)/3785 ml

Explanation of conversions:

(Lsp * 5.0) Conversion of line speed from minute/foot to seconds/inch.

(Dt3−Dt2)/(Dt3−Dt1) Percent of production affected from time of change "Dt2" to the end of the day "Dt3".

(Apr/60) Conversion of milliliters per minute or cubic centimeters per minute to milliliters per second or cubic centimeters per second 1 GALLON/3785 Conversion factor for milliliters or cubic centimeters to gallons.

An output of the source reduction analysis' software compilation per paint, applicator utilizing actual plant data as illustrated in the Style 2 and Style 3 tables, at the end of the specification, is presented in FIG. 8. Conversion tables, as illustrated in FIGS. 6, 7, and 8 were used in conjunction with the software program. Equivalent flow rate values and zone count settings were chosen for all paint colors per paint applicator in this example. These tables may be included within the software program as reference sources for data.

From the above description, a number of advantages of integrating source reduction analysis software for each paint applicator station become evident:

(a) Changes in paint usages per applicator due to trigger point count settings, pushout count settings, and fluid pressures are identified. This allows for economic justification of correcting spray booth operating conditions.

(b) Changes in paint usages per applicator due to paint colors or densities are identified. This minimizes paint usage by adjusting each applicator's pushout and fluid pressure on the current paint color or density.

(c) Daily assessment of paint usages per applicator allows the manufacturer to correct conditions resulting in excessive paint usage.

(d) Products required to treat paint overspray are minimized. The manufacturer will reduce the number of products entering the facility. The manufacturer's costs are lowered.

(e) Products required for cleaning the spray booth due to excessive painting are minimized. The manufacturer will reduce number of products entering the facility. The manufacturer's costs are lowered.

(f) Paint sludge generation, treatment and disposal costs are reduced.

(g) Solvent used to reduce the paint for spraying per applicator is minimized.

(h) Paint wastage due to replacing longer paint supply lines to applicators are identified by the paint change obtained from the pushout count settings.

(i) The applicator data's trigger point count settings, pushout count settings, and fluid pressures can be managed daily to minimize paint usage and costs.

The first variable, trigger point count settings are evaluated at the fluid pressure setting that was present during the time of the adjustment. The other two variables, pushout count settings, and fluid pressures require conversion tables. These conversion tables are illustrated in FIGS. 7 to 9. Pushout count settings conversion table account for the percent of each paint color sprayed in comparison to the total volume of all colors painted. The flow rates are derived from a fluid pressure conversion table to application rates, and a flow zones conversion table that identifies the number of counts per flow zone area and a conversion table that account for the percent of each paint color sprayed in comparison to the total volume of all colors painted.

SUMMARY, RAMIFICATIONS, AND SCOPE

Accordingly, the integration of software source reduction analysis per paint applicator of this invention can be used to ascertain the difference in paint volumes per applicator due to changes in trigger point count settings, pushout count settings, and fluid pressure settings. This provides the user with real time data in terms of paint usage and economics to correct spray booth conditions that caused these adjustments. Additionally, different paint colors' pushout settings are optimized to ensure all colors are at the optimum setting, instead of choosing one setting for all colors that results in paint wastage. Furthermore, the integration of software source reduction analysis per paint applicator has the additional advantages in that:

a) the user can avoid obtaining additional detackification products, and the associated costs by minimizing the amount of paint that is wasted;

b) the user can avoid excess paint spray booth maintenance, and cleaning costs by minimizing paint overspray;

c) the user can reduce paint sludge generation, excessive paint sludge disposal costs, and excessive paint sludge transportation costs;

d) the user can avoid excessive paint reducing solvent usage, and costs;

e) the user can identify excessive paint wastage due to the difference in pushout count settings that are a result of installing paint supply lines that are different in length; and scope of this invention but as merely providing illustrations of some of the presently preferred embodiments of this invention. For example, the software integration may provide graphs of the difference in paint usage, and costs.

```
'           Visual Basic Application Add-In Feature "PAI-APP.XLA"
'           works with Workbook "PAI-DAT.XLS" for
'           Paint Applications: Source Reduction Analysis
'           September 1995
'
'   This function performs the task of converting the supplied data
'   measured in length, time, and metric volume to gallons.
'
    Function CVolume(Cnt, Ipc, LSp, Dt1, Dt2, Dt3, Ttl, Apr, Apc)
'
'   Input variables are as follows:
'       Cnt eq count change                         (relative cell RC[-2])

'       Ipc eq inches per count                     (range name "IPC")

'       LSp eq line speed min per ft                (range name "LSP")

'       Dt1 eq production start date/time           (range name "Time]")

'       Dt2 eq change date/time                     (relative cell RC[-3])

'       Dt3 eq production end date/time             (range name "Time3")

'       Ttl eq total production per style day units (range name "TTL")

'       Apr eq application rate in cc per min       (relative cell RC[-1])

'       Apc eq previous application rate            (relative cell R[-1]C[-1])

'
'
'       The output variable is calculated as follows:
        CVolume = (Cnt * Ipc * (LSp * 5) * (((Dt3 - Dt2) / (Dt3 - Dt1)) * Ttl) * (Apr / 60)) / 3785.412
'                                |_____|   |_____________________|          |_____|  |_____|
'                          min/ft to sec/inch percent of production affected ml/min to ml/sec
'                                            from time of change "Dt2"to                 ml to gallon
'                                            the end of the day "Dt3"
    End Function
'
'
'    Volume Macro
'
'   This macro will create a function call to CVolume in the currently
'   active cell. Variables passed to function CVolume consist of existing
'   range names in PAI-DAT.XLS and cell addresses relative to the active cell.
'
'   Keyboard Shortcut: Ctrl+v also appears in Tools menu as "Volume Calc"
'
Sub Volume()
    ActiveCell.FormulaR1C1 =
        "=CVolume(RC[-2],IPC,LSP,Time1,RC[-3],Time3,TTL,RC[-1],R[-1]C[-1])"
End Sub
'
'
'   TotalV Macro
'
'   This macro will create a call to Excel function SUM in the currently
'   active cell. The range of values for SUM begin at row 1 and end at the
'   row prior to the currently active cell (for the column the currently
'   active cell resides).
'
'   Keyboard Shortcut: Ctrl+t also appears in Tools menu as "Total Vol"
'
Sub TotalV()
    ActiveCell.FormulaR1C1 = "=SUM(R1C:R[-1]C)"
End sub
```

f) the user can manage real time data to make adjustments within the spray booth that will lower paint usage, and paint costs.

Although the description above contains many specifications, these should not be construed as limiting the PAINT APPLICATIONS: Source Reduction Analysis Software Demonstration instructions From Microsoft Windows, start Microsoft Excel application by double-clicking the Excel icon.

From the Excel menu bar select File, then select Open.

Browse to the appropriate drive and/or directory containing the following file: PAI-DAT.XLS Select the PAI-DAT.XLS file and click OK From the Excel menu bar, select Tools, then select Add-ins.

In the Add-Ins dialog box, click the Browse command button.

Browse to the appropriate drive and or directory containing the following file: PAI-APP.XLA Select the PAI-APP.XLA file and click OK.

In the Add-Ins dialog box, click OK

Figure 10:
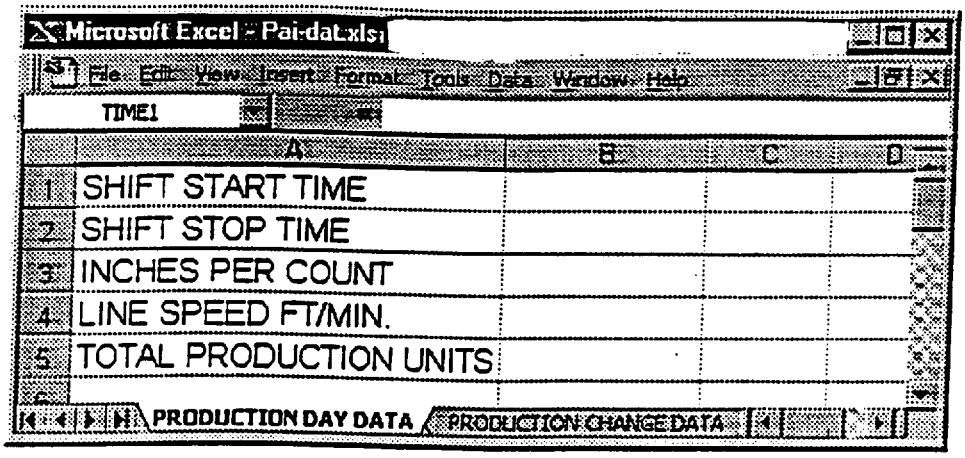
FIGS. 10–12 illustrate illustrative worksheets labeled Production Day Data and Production Change Data.

Select the worksheet, FIG. 10, labeled Production Day Data to make it active.

Move to and highlight the cell (B1) adjacent to "ushift start time".

Enter the date and time in the format MM/DD/YY HH:MM:SS for example: Oct. 2, 1995 4:02:30

Move down and highlight the next cell (B2) adjacent to "shift stop time".

Enter the date and time in the same format described above.

Move down and highlight the next cell (B3) adjacent to "inches per count".

Enter the appropriate number (decimal).

Move down and highlight the next cell (B4) adjacent to "line speed ft/min.".

Enter the appropriate number (decimal).

Move down and highlight the next cell (B5) adjacent to "total production units".

Enter the appropriate number (decimal).

Figure 11:
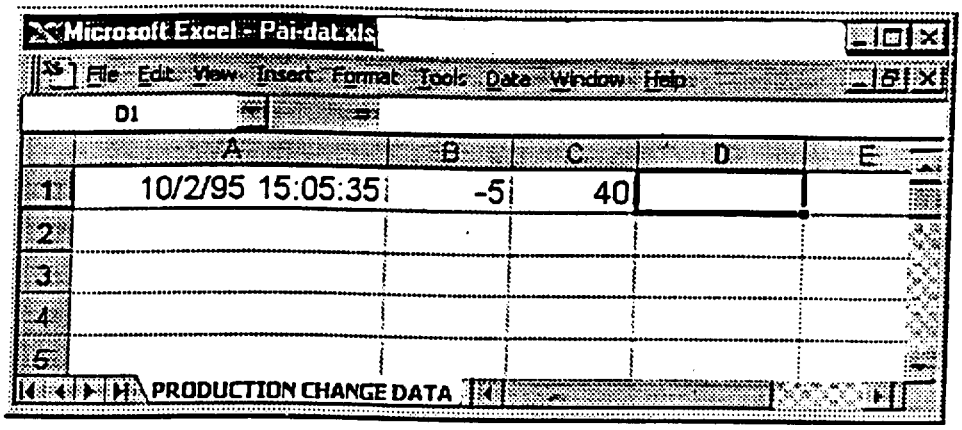

Select the worksheet, FIG. 11, labeled Production Change Data.

Move to and highlight the first empty cell of the worksheet (use Ctrl+Home to go to cell A1)

Enter the process change date and time in the format MM/DD/YY HH:MM:SS.

Move right and highlight the next adjacent cell (B1).

Enter the Count Change (difference of new value less old value).

Move right and highlight the next adjacent cell (C1).

Enter the Flow Rate at time of the change.

Move right and highlight the next adjacent cell (D1).

Activate the Volume Calculation formula macro by either of the following methods:

Press Ctrl+V or

From the menu bar select Tools, then select Volume Calc.

If more change data is to be entered, move to and highlight the next line in the first column (A2, etc.). Repeat the above process for each Production Change data set.

Figure 12:
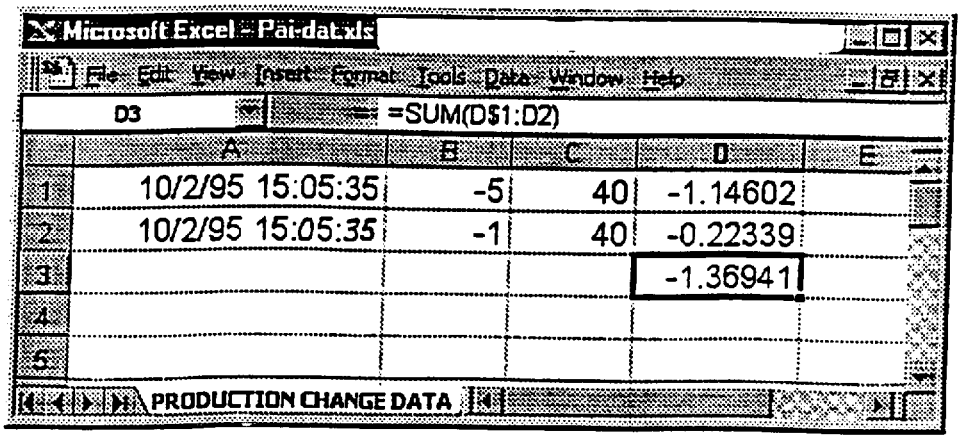

When all change data has been entered, move down and highlight the next available line in the fourth column (D), see FIG. 12.

Activate the Total Volume calculation formula macro by either of the following methods:

Press Ctrl+T or

From the menu bar select Tools, then select Total Vol.

The result of the Total Volume calculation is the sum of all Volume Calc preferred upon the change data.

To close the Workbook, From the menu bar select File, then select Exit.

Answer NO to the option for saving changes.

| | |
|---|---|
| shift start time | 7/31/95 15:00:00 |
| shift stop time | 7/31/95 18:00:00 |
| inches per count | 1 |
| line speed min/ft. | 0.033 |
| total production units | 369 |

STYLE 2
Changes in paint values due to adjustments in fluid pressure settings

Applicator 1.2

| Date/Time of change | Counts in flow zone | Application rate change | Volume calculation |
|---|---|---|---|
| 7/31/95 15:21:35 | 6.001 | 22.5 | 0.031855206 |
| | Daily volumetric change total | | 0.031855206 |

Applicator 1.3

| Date/Time of change | Counts in flow zone | Application rate change | Volume calculation |
|---|---|---|---|
| 7/31/95 15:23:07 | 6.001 | 22 | 0.030845834 |
| 7/31/95 15:23:39 | 6.001 | 22 | 0.030740972 |
| 7/31/95 15:23:52 | 5.0832 | 22 | 0.026003327 |
| | Daily volumetric change total | | 0.087590132 |

Applicator 2.2

| Date/Time of change | Counts in flow zone | Application rate change | Volume calculation |
|---|---|---|---|
| 7/31/95 15:22:14 | 6.001 | 7.6 | 0.010715831 |
| | Daily volumetric change total | | 0.010715831 |

Applicator 3.1

| Date/Time of change | Counts in flow zone | Application rate change | Volume calculation |
|---|---|---|---|
| 7/31/95 15:24:32 | 10.0045 | 11.7 | 0.027101413 |
| 7/31/95 15:24:34 | 8.4744 | 11.7 | 0.022951569 |
| 7/31/95 17:09:48 | 10.0045 | 7.8 | 0.005834009 |
| 7/31/95 17:09:54 | 8.4744 | 7.8 | 0.004931905 |
| 7/31/95 17:09:58 | 4.3549 | 7.8 | 0.002531079 |
| | Daily volumetric change total | | 0.063349975 |

Applicator 3.2

| Date/Time of change | Counts in flow zone | Application rate change | Volume calculation |
|---|---|---|---|
| 7/31/95 15:25:44 | 8.4744 | 221 | 0.43027561 |
| 7/31/95 15:25:48 | 10.0045 | 13.6 | 0.03124583 |
| | Daily volumetric change total | | 0.46152144 |

Applicator 3.4

| Date/Time of change | Counts in flow zone | Application rate change | Volume calculation |
|---|---|---|---|
| 7/31/95 15:26:09 | 10.0045 | 7.4 | 0.016962818 |
| 7/31/95 15:26:11 | 8.4744 | 7.4 | 0.014365392 |
| 7/31/95 15:26:54 | 10.0045 | 11.1 | 0.02532019 |
| 7/31/95 15:26:55 | 8.4744 | 11.1 | 0.021445355 |
| | Daily volumetric change total | | 0.078093755 |

Applicator 5.2

| Date/Time of change | Counts in flow zone | Application rate change | Volume calculation |
|---|---|---|---|
| 7/31/95 17:51:13 | 13.9995 | −40 | −0.00732496 |
| | Daily volumetric change total | | −0.00732496 |

-continued

| | |
|---|---|
| shift start time | 7/31/95 15:00:00 |
| shift stop time | 7/31/95 18:00:00 |
| inches per count | 1 |
| line speed min/ft. | 0.033 |
| total production units | 333 |

STYLE 3
Changes in paint values due to adjustments in trigger point count settings

| Applicator 5.2 | | | |
|---|---|---|---|
| Date/Time of change | Count change in flow zone | Application rate | Volume Calculation |
| 7/31/95 17:20:50 | 18 | 96.67 | 0.091595071 |
| | Daily volumetric change total | | 0.091595071 |

STYLE 3
Changes in paint values due to adjustments in push out settings

| Applicator 5.1 | | | |
|---|---|---|---|
| Date/Time of change | Count change in flow zone | Application rate | Volume Calculation |
| 7/31/95 17:17:18 | −1.177 | 138.33 | −0.009343551 |
| | Daily volumetric change total | | −0.009343551 |

Having described my invention, I claim:

1. A combination for minimizing paint usage by computer-operated paint application equipment, comprising:

a paint processing line having conveyor means for conveying a workpiece along a path of motion;

applicator nozzle means mounted in a painting location adjacent said path of motion for discharging paint toward the workpiece;

computer-operated means for initiating the delivery of paint to the applicator nozzle means for discharge toward the workpiece to form a coating thereon in response to the workpiece passing a first workpiece position with respect to said painting location;

means for changing the location of the workpiece along said path of motion at which the computer-operated means initiates the delivery of paint from said first workpiece position to a second workpiece position to change the amount of paint discharging toward the workpiece;

data processing means including calculating means for determining the presence of a predetermined change in the volume of paint consumption caused by the change in the workpiece position;

a source of pressurized air connected to the applicator nozzle means;

the computer-operated means being operable to initiate the discharge of air during a pushout cycle toward the applicator nozzle means for removing residual paint therein and discharging such residual paint toward the workpiece, in response to the workpiece passing a first pushout workpiece position with respect to said painting location;

the computer-operated means being operable to change said first pushout workpiece position to a second pushout workpiece position to vary the amount of paint deposited on the workpiece; and the calculating means being programmed to calculate a predetermined change in the volume of paint being discharged toward the workpiece during a pushout cycle.

2. A combination as defined in claim 1, in which the calculating means measures the quantity of paint used as a result of a change in the pushout workpiece position in terms of counts and wherein a count is a measure of an equivalent distance that the conveyor means travels during a pushout cycle.

3. A combination for minimizing paint usage by computer operated paint application equipment, comprising:

a paint processing line having conveyor means for conveying a workpiece along a path of motion;

applicator nozzle means mounted in a painting location adjacent said path of motion for discharging paint toward the workpiece;

computer-operated means for initiating the delivery of paint to the applicator nozzle means for discharge toward the workpiece to form a coating thereon in response to the workpiece passing a first workpiece position with respect to said painting location;

means for changing the location of the workpiece along said path of motion at which the computer-operated means initiates the delivery of paint from said first workpiece position to a second workpiece position to change the amount of paint discharging toward the workpiece;

data processing means including calculating means for determining the presence of a predetermined change in the volume of paint consumption caused by the change in the workpiece position;

the conveyor means travels a predetermined number of counts during a complete painting cycle beginning with the initiation of the discharge of paint to the final discharge of paint by the applicator nozzle means toward the workpiece, and the distance between the first workpiece position and the position of the initiation of a complete painting cycle defines a first count setting, and the distance between the first workpiece position and a later workpiece position in which the computer-operated means terminates the discharge of paint from the applicator nozzle means defines another count setting, and a computer-operated change in either of said count settings varies the amount of paint discharged toward the workpiece, and the calculating means are programmed to determine the volume of paint usage during later discharges of paint from the applicator nozzle means resulting from said computer-operated change.

4. A combination as defined in claim 3, which the data processing means includes a memory for storing the time of each computer-operator change of the application nozzle means and in which following data is recorded in the memory;

count change (abbreviated as Cnt), inches per count (abbreviated as Ipc), line speed with units expressed in minutes per feet (abbreviated as Lsp), production startdate/time (abbreviated as Dt1), change date/time (abbreviated as Dt2), production end date/time (abbreviated as Dt3), total production/style day units (abbreviated as Tt1), application rate in cubic centimeters or milliliters per minute (abbreviated as Apr), and previous application rate (abbreviated as Apc) and the calculating means was the following formula to determine the change in paint volume per applicator means:

CVolume=(Cntlpc(Lsp5.0)(((Dt3−Dt2)/(Dt3−Dt1))TtL)(Apr/60)/3785 ml Explanation of conversions: (Lsp 5.0) Conversion of line speed from minute/feet to seconds/inch (Dt3−Dt2)/(Dt3−Dt1) Percent of production affected from time of change "Dt2" to the end of a production day.

5. A combination as defined in claim 3, including data processing means for recording such changes and the time of the change during a work shift, and the calculating means determines the change in the volume of paint used during the remainder of the work shift from the time of the change.

6. A paint application system, comprising:

a paint processing line having conveyor means for conveying a workpiece along a path of motion;

applicator nozzle means mounted in a painting location adjacent said path of motion for discharging paint toward the workpiece;

computer-operated means for initiating the delivery of paint to the applicator nozzle means for discharge toward the workpiece to form a coating thereon in response to the workpiece passing a first workpiece position with respect to said painting location;

means for changing the location of the workpiece along said path of motion at which the computer-operated means initiates the delivery of paint from said first workpiece position to a second workpiece position to change the amount of paint discharging toward the workpiece;

data processing means including calculating means for determining the presence of a predetermined change in the volume of paint consumption caused by the change in the workpiece position; and a source of pressurized air connected to the applicator nozzle means, and in which the computer-operated means are operable to initiate the discharge of air during a pushout cycle toward the applicator nozzle means for removing residual paint therein and discharging such residual paint toward the workpiece, in response to the workpiece passing a first pushout workpiece position with respect to said painting location, and the computer-operated means is operable to change said first pushout workpiece position to a second pushout workpiece position to vary the amount of paint deposited on the workpiece, and the calculating means are programmed to calculate a predetermined change in the volume of paint being discharged toward the workpiece during a pushout cycle.

7. A print application system as defined in claim 6, in which the calculating means measures the quantity of paint used as a result of a change in the pushout workpiece position in terms of counts and wherein a count is a measure of an equivalent distance that the conveyor means travels during a pushout cycle.

8. A paint application system, comprising:

a paint processing line having conveyor means for conveying a workpiece along a path of motion;

applicator nozzle means mounted in a painting location adjacent said path of motion for discharging paint toward the workpiece;

computer-operated means for initiating the delivery of paint to the applicator nozzle means for discharge toward the workpiece to form a coating thereon in response to the workpiece passing a first workpiece position with respect to said painting location;

means for changing the location of the workpiece along said path of motion at which the computer-operated means initiates the delivery of paint from said first workpiece position to a second workpiece position to change the amount of paint discharging toward the workpiece;

data processing means including calculating means for determining the presence of a predetermined change in the volume of paint consumption caused by the change in the workpiece position; and in which the conveyor means travels a predetermined number of counts during a complete painting cycle beginning with the initiation of the discharge of paint to the final discharge of paint by the applicator nozzle means toward the workpiece, and the distance between the first workpiece position and the position of the initiation of a complete painting cycle defines a first count setting, and the distance between the first workpiece position and a later workpiece position in which the computer-operated means terminates the discharge of paint from the applicator nozzle means defines another count setting, and a computer-operated change in either of said count settings varies the amount of paint discharged toward the workpiece, and the calculating means are programmed to determine the volume of paint usage during later discharges of paint from the applicator nozzle means resulting from said computer-operated change.

* * * * *